US010294648B2

(12) United States Patent
Connell

(10) Patent No.: US 10,294,648 B2
(45) Date of Patent: May 21, 2019

(54) TOILET FLANGE THAT CAN BE ROTATED DURING INSERTION HAVING A GRIPPING RING AND A DURABLE SAFETY SEAL

(71) Applicant: Darrell Gregory Connell, Sherman, TX (US)

(72) Inventor: Darrell Gregory Connell, Sherman, TX (US)

( * ) Notice: Subject to any disclaimer, the term of this patent is extended or adjusted under 35 U.S.C. 154(b) by 0 days.

(21) Appl. No.: 15/998,311

(22) Filed: Aug. 6, 2018

(65) Prior Publication Data

US 2018/0347171 A1 Dec. 6, 2018

Related U.S. Application Data

(63) Continuation-in-part of application No. 15/465,390, filed on Mar. 21, 2017, now abandoned, which is a continuation of application No. 13/930,461, filed on Jun. 28, 2013, now abandoned.

(51) Int. Cl.
*E03D 11/16* (2006.01)

(52) U.S. Cl.
CPC ..... *E03D 11/16* (2013.01); *Y10T 29/4943* (2015.01)

(58) Field of Classification Search
CPC ..... E03D 11/13; E03D 11/16; E03D 11/17
USPC ..... 4/252.1, 252.4, 252.5
See application file for complete search history.

(56) References Cited

U.S. PATENT DOCUMENTS 1,613,926 A 1/1927 Bropson
1,805,816 A 5/1931 Fleming
2,837,750 A 6/1958 Robinson
3,762,684 A 10/1973 Stein
3,775,780 A 12/1973 McEwen
4,609,209 A 9/1986 Ralls
4,730,854 A 3/1988 Cuschera
(Continued)

FOREIGN PATENT DOCUMENTS

CA 2002852 A1 6/1992

OTHER PUBLICATIONS

Website: https://www.amazon.com/Oatey-43539-Flange-Replacement-4-Inch/dp/B000DZHDQG Feb. 24, 2017 Oatey 43539 PVC Cast Iron Flange Replacement, 4-Inch.
(Continued)

*Primary Examiner* — Huyen Le

(57) ABSTRACT

A toilet flange for facilitating installation of a toilet onto a drain pipe is provided. The toilet flange is rotationally adjustable while being irreversibly inserted into or onto the drain pipe. The toilet flange includes a flanged pipe cooperative with a circumferential gripping ring. The flanged pipe has an outer surface that includes a circumferential channel. The circumferential gripping ring cooperates with the circumferential channel so as to provide rotational adjustment while the flanged pipe is irreversibly inserted into or onto the drain pipe. The flanged pipe outer surface includes a circumferential groove for accommodating a sealing ring seated in the circumferential groove. The circumferential gripping ring includes a channel guide ring that is seated rotatably within the circumferential channel, and a plurality of gripping projections extending from the channel guide ring. The toilet flange is simpler and faster to install, providing a longer-lasting seal than a traditional toilet flange.

20 Claims, 9 Drawing Sheets

(56) References Cited

U.S. PATENT DOCUMENTS

| | | | | |
|---|---|---|---|---|
| 4,827,539 | A * | 5/1989 | Kiziah | E03D 11/16 285/303 |
| 5,018,224 | A | 5/1991 | Hodges | |
| 5,232,250 | A | 8/1993 | Bonacci | |
| 5,492,372 | A | 2/1996 | Dranberg | |
| 5,603,530 | A | 2/1997 | Guest | |
| 5,937,450 | A * | 8/1999 | Jones | F16L 37/04 285/56 |
| 6,026,521 | A | 2/2000 | Atkins | |
| 6,286,553 | B1 | 9/2001 | Morgan | |
| 6,438,765 | B1 | 8/2002 | Johnson et al. | |
| 6,598,241 | B1 | 7/2003 | Williams | |
| 6,634,034 | B2 | 10/2003 | Rendell | |
| 7,481,462 | B2 | 1/2009 | Arning et al. | |
| 8,281,421 | B2 | 10/2012 | Hughes | |
| 8,561,218 | B1 | 10/2013 | Arce | |
| 8,898,823 | B2 | 12/2014 | McHugh, III | |
| 8,955,172 | B2 | 2/2015 | Culwell | |
| 9,068,678 | B2 | 6/2015 | Whitehead | |
| 9,234,340 | B2 | 1/2016 | Hong et al. | |
| 2003/0093855 | A1 | 5/2003 | Rendell | |
| 2005/0035558 | A1* | 2/2005 | Dipzinski | E03D 11/16 277/628 |
| 2005/0050623 | A1* | 3/2005 | Greene | E03D 11/16 4/252.4 |
| 2011/0162132 | A1 | 7/2011 | Penunuri et al. | |
| 2012/0240319 | A1 | 9/2012 | Yssel | |
| 2015/0204059 | A1* | 7/2015 | Whitehead | E03D 11/16 4/252.5 |

OTHER PUBLICATIONS

Website: https://www.amazon.com/Oatey-43651-Twist-NSet-Closet-Flange/dp/B0002YU3YM/ref=pd_sim_60_5?_encoding=UTF8&psc=1&refRID=M77A5VS1KYXQRMTB4JG9 Feb. 24, 2017 Oatey 43651 PVC Twist-N-Set Closet Flange, 4-Inch.

Website: https://www.amazon.com/dp/B01I51PPAU/ref=psdc_3226897011_t3_B000BQUJEA Feb. 24, 2017 Culwell PC4 Floor Protecting Toilet Flange with Drop-Fit Compression/Replacement, 4".

* cited by examiner

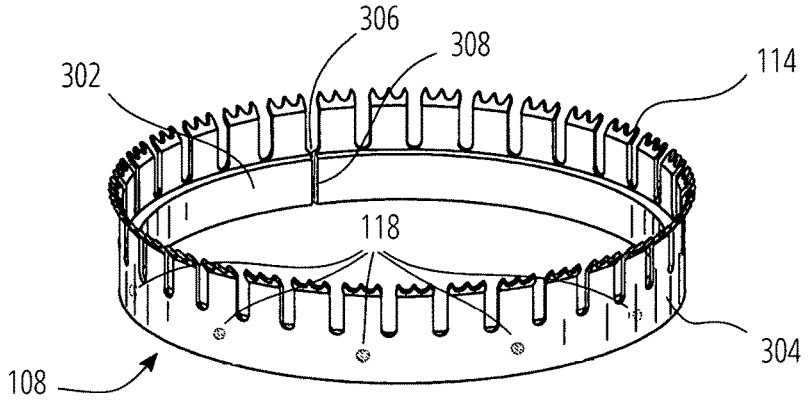
Fig. 3A
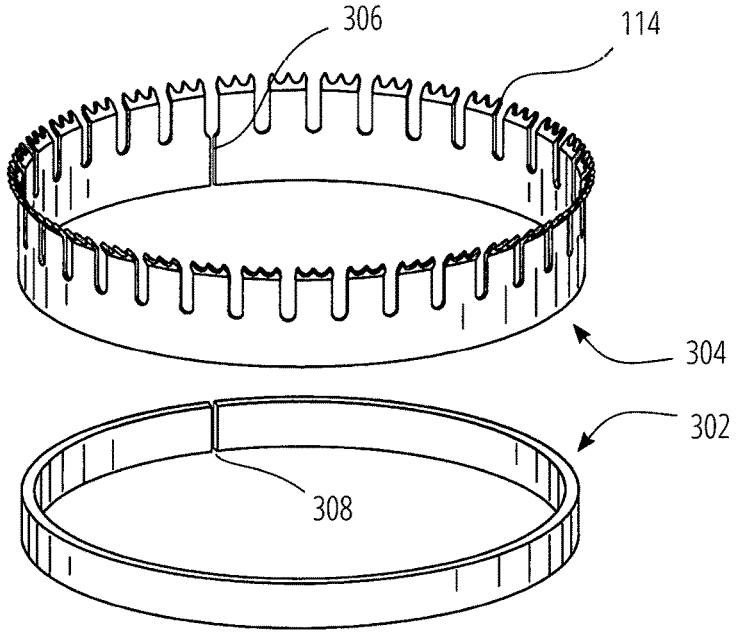
Fig. 3B
FIG. 3

TOILET FLANGE THAT CAN BE ROTATED DURING INSERTION HAVING A GRIPPING RING AND A DURABLE SAFETY SEAL

CROSS-REFERENCE TO RELATED APPLICATIONS

The present application claims priority as a Continuation in Part of U.S. patent application Ser. No. 15/465,390 titled, "Self-Sealing Closet Flange", filed Mar. 21, 2017, which is a Continuation of U.S. patent application Ser. No. 13/930,461 titled, "Self-Sealing Closet Flange", filed Jun. 28, 2013, and which is incorporated herein in its entirety by this reference.

FIELD OF THE INVENTION

This invention relates generally to plumbing fixtures, and more specifically to toilet flanges.

BACKGROUND OF THE INVENTION

Toilet plumbing installation and repairs are common in both new and older homes. Traditionally, a toilet, commode, or water closet is positioned on a floor surface and connected to a toilet flange, which is also known as a closet flange or a water closet flange. A toilet flange is a pipe fitting that connects the toilet to a drain pipe. Toilet flanges are usually positioned between the bottom surface of the toilet and the surface of the bathroom floor. The toilet flange is positioned directly below the toilet trap's outlet opening so that any water flushed from the toilet goes directly into the toilet flange, and then into the drain pipe.

Typically, before the toilet is installed, the toilet flange is installed either in the inside or on the outside of the upper portion of the drain pipe. However, if the toilet flange is installed inside a drain pipe, the effective inside diameter of the drain pipe is reduced, and therefore the fluid flow inside the drain pipe can be restricted. For this reason, traditional toilet flanges are often installed on the outside of a drain pipe. However, depending on the composition, type, age, and dimensions of the drain pipe, toilet flanges are also installed on the inside of the drain pipe.

Traditional toilet flanges are typically made of PVC, cast iron, brass, or steel. To form a good liquid and gas seal, it is common for a traditional toilet flange to be glued onto the drain pipe. Once the traditional toilet flange is secured to the drain pipe, then typically a wax ring is used to seal any space between the upper surface of the traditional toilet flange and the bottom of the toilet, to prevent the escape of potentially unsanitary or hazardous fluids or gases. Typically, after the wax ring is installed between the toilet and the toilet flange, the toilet is carefully lowered onto the wax ring so as to maintain alignment between the toilet bolt holes and the toilet flange bolts, the toilet is bolted to the flange, and as the toilet is lowered and bolted, the wax ring is compressed to form a liquid and gas seal.

A toilet flange has at least two essential functions: 1) to firmly secure the toilet to the drain pipe so that the toilet and the upper portion of the drain pipe do not move relative to each other, and 2) to assist in forming a liquid and gas seal at the junction between the bottom of the toilet and the upper portion of the drain pipe. This liquid and gas seal prevents the flow of unsanitary or toxic liquids and gases into the bathroom and the bathroom sub-flooring. These undesirable liquids and gases can originate from either the toilet or the sewage system.

A common reason for the failure of a toilet installation is a malfunction of the toilet flange. A damaged or broken toilet flange can cause many problems, such as the leaking of unsanitary or hazardous liquids or sewer gases, which may expose the inhabitants to disease, and cause damage to the dwelling. These leaks can cause damage to adjoining rooms, and cause damage to rooms located below the leaking toilet. Therefore, the resulting damage from a malfunctioning toilet flange can be especially costly in multi-story apartments or multi-story commercial buildings.

Traditionally, the liquid and gas seal is formed by the toilet flange in cooperation with a wax ring. As mentioned, upon installation the traditional wax ring is compressed between the bottom of the toilet and the upper surface of the toilet flange, with the toilet flange being attached to the top portion of the drain pipe. The traditional wax ring is initially soft, and flexible enough to conform to both the surface of the bottom of the toilet and the top of the toilet flange, to form a liquid and gas seal.

However, due to the physical characteristics of wax, the ability of the wax ring to conform to the bottom surface of the toilet and the top surface of the traditional closet flange degrades with normal use, and with the passage of time. A typical toilet is used at least several hundred times per year. After several years of normal toilet use, failures of the wax ring seal are common. This failure is due to several factors, including the movement of the toilet caused by the weight of a person being repeatedly placed on the toilet which causes changes in the wax ring's shape, and the expansion and contraction of the wax ring due to changes in temperature over years. Small cracks and gaps can develop in the wax ring seal, which can become larger with time, and normal wear and tear often results in failure of the traditional toilet wax ring seal.

Labor costs are an important consideration when performing plumbing work. If a traditional toilet flange is installed onto the outside of a drain pipe, the plumber must clear any debris from the area immediately surrounding the drain pipe so as to expose the outer upper part of the drain pipe.

As part of a building construction process, the drain pipe may be protected from concrete work and other construction work by covering the drain pipe with protective cardboard or plastic. As a result, in new construction or remodeling, the plumber often encounters a drain pipe surrounded by debris, such as pieces of cardboard or plastic leftover from the concrete forms, pieces of concrete, or parts of tile or sub-flooring that are too close to the drain pipe to allow installation of the traditional toilet flange. Debris removal can be very time consuming and can add significantly to the plumber's labor costs, which can include: digging out any cardboard or plastic, chiseling out surrounding concrete, and removing any tile or sub-flooring materials. In addition, using traditional methods, labor and time costs may be needed to cut the drain pipe to the proper height to accommodate a wax ring, and labor and time are often needed to glue the flange to the exterior of the drain pipe, with additional time needed for the glue to dry.

Another factor increasing the plumber's labor costs when using a traditional toilet flange is the need for two people to position the toilet over the toilet flange. Typically, a toilet has two bolt holes at the base of the toilet which must be guided over two flange bolts that extend upright from the toilet flange. Traditionally, one person lifts the toilet above the floor, but this person cannot see underneath the toilet since the toilet that they are lifting is blocking their view. A second person is therefore needed to stand to the side of the toilet to look underneath the toilet to locate the two toilet flange bolts and make sure the flange bolts maintain an upright position, and then guide the toilet onto the flange bolts. This need for a second person to guide the toilet onto the traditional toilet flange bolts increases the plumber's total labor costs.

Selecting a correctly sized wax ring can also increase the plumber's time and labor costs. Traditional wax rings are available in different sizes. The wax ring must be large enough to cover both of the surfaces to form a good seal, but not so large as to form an obstruction within the drain pipe once the wax ring is compressed, due to there being excess wax. The height of the wax ring selected by the plumber will depend on the amount of space between the upper surface of the traditional toilet flange and the bottom of the toilet. If this space is large, a tall wax ring is required. Experimentation with different shapes and sizes of wax rings may slow the plumber's work and increase his costs.

Additional labor costs may be incurred while positioning and attaching the traditional toilet flange to the upper portion of the drain pipe. Traditionally, the toilet flange is often glued to the top portion of a drain pipe. Once the glue has set, the plumber may realize that the bolts and bolt holes in the toilet flange are not properly aligned with the toilet bolt holes, or the flange bolts and bolt holes may not be aligned with the desired final position of the toilet within the room. Therefore, an additional source of time and labor costs for the plumber can be the cost of unbolting the toilet from the incorrectly placed toilet flange, scraping off all of the messy wax residue left by the wax ring, and removing the incorrectly glued toilet flange from the drain pipe. In addition, the plumber has the additional cost of gluing a second traditional toilet flange, with a corrected bolt hole orientation, onto the top portion of the pipe. These additional labor costs may be expended because traditional toilet flanges are attached to the upper portion of a drain pipe in a fixed and irreversible manner, using a method such as gluing the toilet flange to the drain pipe.

Culwell, U.S. Pat. No. 8,955,172 B2 teaches various clamping means, such as using one or more screws, to clamp a toilet flange to a drain pipe, or to components of the sub-flooring. A commercially available product is the Culwell 4 Inch Drop Fit Compression Toilet Flange. However, if the plumber needs to rotationally adjust the Culwell toilet flange to the location of the toilet bolt holes, the rotational angle of the Culwell toilet flange cannot be quickly changed without first unscrewing the clamping screws, repositioning the toilet flange, and then retightening the clamping screws.

Penunuri, et. al. 2011/0162132 A1teaches a toilet flange for insertion into a toilet flange by a pressure fit, using a downward insertion pressure on a flexible gasket to secure the flange in place, but only the friction between the flexible gasket and the drain pipe secures the toilet flange within the drain pipe with respect to any upward force on the toilet flange, and therefore the toilet flange may not be securely anchored within the drain pipe.

Johnson, et. al. U.S. Pat. No. 6,438,765 B1teaches a toilet ring adapter with a male screw flange which screws into a cooperating flexible female screw ring, and thereby pushes the female screw ring against the inside of a drain pipe to form a friction-fit seal. However, the rotational angle of the toilet ring adapter cannot be changed without unscrewing the male screw flange, repositioning the angle of the female screw ring, and then retightening the apparatus' male screw, which may require several attempts. Also, only the friction between the female screw ring and the drain pipe secures the toilet flange within the drain pipe with respect to any upward force on the toilet ring adapter, and therefore the toilet ring adapter may not be securely anchored within the drain pipe.

SUMMARY OF THE INVENTION

The toilet flange of the invention addresses many of the shortcomings of traditional closet flanges. The toilet flange of the invention is simpler and faster to install than a traditional toilet flange. The toilet flange of the invention provides a longer lasting seal than a traditional toilet flange. Providing a longer lasting seal reduces the number of leaks from a broken toilet seal. This is a major advantage, since a toilet flange leak can release unsanitary or toxic fluids and gases, such as sewer gases, into the dwelling. A toilet flange leak can spread disease, can cause unpleasant odors, and can damage the structure of the dwelling by staining the walls, ceilings, and floors, damaging plaster and drywall, and by contaminating many of the building's structural components so that they must be cleaned or replaced. The toilet flange of the invention minimizes such leaks, when compared to traditional toilet flanges.

The toilet flange of the invention has an embodiment that is inserted into the inside of the top portion of a drain pipe. This embodiment includes a circumferential gripping ring which is rotatably seated within a circumferential channel that is along the outside of the pipe portion of the toilet flange. The circumferential gripping ring in cooperation with the circumferential channel provides a one-way, irreversible insertion into the inside of the top portion of the toilet drain. The circumferential gripping ring also cooperates with the circumferential channel to provide convenient rotational adjustment of the toilet flange with respect to the drain pipe. This means the plumber can easily change the rotational angle of the toilet flange once it is inserted into the drain pipe, which facilitates lining up the bolts on the toilet flange with the bolt holes on the toilet. Therefore the rotational angle of the toilet flange can be quickly modified without unscrewing any screws, and without regluing any joints, for a faster, simpler, and less costly toilet installation.

The embodiment that is inserted into the inside of the top portion of a drain pipe also has a circumferential groove disposed along the outside of the pipe portion of the toilet flange, which seats a side sealing ring which makes a seal with the inside of the drain pipe. This side sealing ring prevents unsanitary or toxic fluids or gases from the sewage system from rising above the side sealing ring of the toilet flange and entering the residence. For drain pipes with a rough internal surface, the side sealing ring can be replaced by a side sealing gasket, which has a larger contact sealing area. For embodiments where the side sealing ring is located below the circumferential gripping ring, the side sealing ring also protects the circumferential gripping ring from sewage fluids or gases. This minimizes corrosion of the circumferential gripping ring and prevents dirt, liquids, and debris from interfering with the gripping action of the circumferential gripping ring.

The toilet flange of the invention also has an embodiment that is inserted over the outside of the top portion of a drain pipe. This alternative embodiment includes a circumferential gripping ring which is rotatably seated within a circumferential channel that is along the inside of the pipe portion of the toilet flange. The circumferential gripping ring in cooperation with the circumferential channel provides a one-way, irreversible insertion onto the outside of the top portion of the toilet drain. The circumferential gripping ring also cooperates with the circumferential channel to provide convenient rotational adjustment of the toilet flange with respect to the drain pipe. This means a plumber can easily change the rotational angle of the toilet flange once it is placed over the outside of the drain pipe, which facilitates lining up the bolts on the toilet flange with the bolt holes on the toilet. Therefore the rotational angle of the toilet flange can quickly be modified without unscrewing any screws, and without regluing any joints, for a faster, simpler, and less costly toilet installation.

The embodiment that is inserted over the outside of the top portion of a drain pipe also has a circumferential groove disposed along the inside of the pipe portion of the toilet flange, which seats a side sealing ring which makes a seal with the outside of the drain pipe. This side sealing ring prevents unsanitary or toxic fluids or gases from the sewage system from rising above the side sealing ring of the toilet flange and entering the residence. For drain pipes with a rough external surface, the side sealing ring can be replaced by a side sealing gasket, which has a larger contact sealing area. For embodiments where the side sealing ring is located below the circumferential gripping ring, the side sealing ring also protects the circumferential gripping ring from sewage fluids or gases. This minimizes corrosion of the circumferential gripping ring and prevents dirt, liquids, and debris from interfering with the gripping action of the circumferential gripping ring.

The circumferential gripping ring has a plurality of gripping projections that secure the self-sealing closet flange to a surface of the drain pipe. The projections are at an angle such that the teeth do not resist the movement of inserting the toilet flange into the drain pipe, but the angle of the projections is such that they strongly resist the pulling of the toilet flange out of the drain pipe, once the toilet flange has been inserted into the drain pipe. This prevents the removal of the toilet flange of the invention from the drain pipe. Since the toilet flange is bolted to the toilet, and the circumferential gripping ring will not allow the toilet flange to be pulled out of the drain pipe, this also provides an anchoring of the toilet to the drain pipe, holding them firmly together in relation to each other.

One embodiment of the toilet flange of the invention uses an elastomeric upper flange seal, for use on the upper surface of the toilet flange, such as an O-ring or a gasket seal. Embodiments that use an elastomeric upper flange seal can also have a circumferential groove within the top surface of the toilet flange to seat the elastomeric O-ring or gasket. Another embodiment does not use an elastomeric upper flange seal, but instead uses a traditional wax ring seal. The embodiment selected will depend on the plumber's needs for a particular toilet installation.

There are advantages to using an elastomeric upper flange seal when compared to a wax ring seal. An elastomeric upper flange seal, such as an elastomeric O-ring or gasket seal, can withstand much higher fluid pressures and gas pressures than a wax ring seal. In addition, an elastomeric upper flange seal is much more durable, and degrades much more slowly, when compared to a wax ring seal.

During multiple years of use, the toilet and the drain pipe are exposed to many cycles of temperature change, and many cycles of vibration and movement due to the regular use of the toilet. A typical wax seal will often degrade and leak within as few as 4 or 5 years. An elastomeric seal can withstand many more than 5 years of use. This is due to the physical properties of elastomer versus wax. An elastomeric upper flange seal is much more durable than a wax seal when exposed to cycles of physical vibration and movement of the toilet and the drain pipe. The superior durability of the elastomeric upper flange seal will give maintenance-free use of the toilet for several additional years when compared to a wax ring, resulting in lower pluming repair costs.

If a toilet flange leak is prevented, this can prevent damage to the subflooring around the toilet, prevent damage to surrounding rooms, and also prevent damage to additional rooms below the toilet. This can eliminate the cost of repairing expensive damage to the residence's structure caused by a toilet flange's wax ring leak. Therefore, the repair costs that are eliminated by using an embodiment of the toilet flange of the invention with an elastomeric upper flange seal, such as an O-ring or a gasket, can be especially great for multi-story apartments or multi-story commercial buildings.

Despite the advantages of an elastomeric upper flange seal, the plumber may occasionally wish to use a wax ring with the toilet flange of the invention. An example of this would be for use on a toilet that has a damaged lower surface where the damaged surface cannot be completely sealed by an elastomer seal, but it can be sealed by a wax ring. If the plumber wishes to use a wax ring, the toilet flange of the invention also has an embodiment for use with a wax ring. In this embodiment, the elastomer upper flange seal is not used, and a wax ring in contact with the flange's upper surface is used instead. In this embodiment, the application of the wax ring between the lower surface of the toilet and the upper surface of the toilet flange proceeds in a similar manner as in the use of wax ring in a traditional toilet flange.

One embodiment of the toilet flange of the invention is installed into the inside of the top portion of the drain pipe. Another embodiment is installed onto the outside of the top portion of the drain pipe. The embodiment selected will depend on the plumber's needs for a particular toilet installation.

There are advantages to using the embodiment that is installed into the inside of the top portion of the drain pipe. With this embodiment, since the toilet flange is installed into the inside of the drain pipe, the toilet flange can be installed over an existing externally applied toilet flange without removing the old toilet flange, even if the existing toilet flange is broken. This saves the plumber both time and labor. In this case, the toilet flange of the invention will easily insert into the inside of the drain pipe, and form a secure seal to the inside of the drain pipe, bypassing the old externally applied traditional toilet flange.

A source of labor costs when installing the traditional toilet flange is the plumber's need to clear away debris surrounding the drain pipe. The debris can include pieces of cardboard, or pieces of plastic leftover from concrete forms, pieces of concrete, or parts of tile or sub-flooring that are too close to the drain pipe to allow installation of the traditional toilet flange. This debris removal can be very time consuming and can add significantly to the plumber's labor costs, which can include: digging out any cardboard or plastic, chiseling out surrounding concrete, and removing any tile or sub-flooring materials.

This highlights an additional advantage of the embodiment of the invention that is installed into the inside of the top portion of the drain pipe. Because this embodiment simply slides into the inside of the upper portion of the drain pipe, there can be a great reduction in the plumber's time and labor, since there is no need to prepare the flooring around the outside of the drain pipe. Also, because of the circumferential gripping ring, the toilet flange of the invention is secured to the drain pipe and the toilet without the support of the flooring around the drain pipe.

In addition, when using a traditional toilet flange, labor and time may be needed to cut the drain pipe to the proper height to accommodate a wax ring, and labor and time may be needed to glue the flange to the exterior of the drain pipe, with additional time added for the drying of the glue.

This highlights an additional advantage of the toilet flange of the invention, which is the ability of the toilet flange of the invention to accommodate drain pipes of differing heights relative to the floor's surface. The top of the drain pipe may be positioned above the floor surface, at a height even with the floor surface, or below the floor surface. This is because, depending on the embodiment of the toilet flange of the invention, the pipe portion of the toilet flange either extends down into the inside of the drain pipe, or down onto the outside of the drain pipe, and therefore there is flexibility in the vertical location at which the side sealing ring contacts the wall of the drain pipe to form a fluid and gas seal. Therefore labor costs can be saved by not having to cut the top of the drain pipe to an exact height, or extend a drain pipe that is too short, when using the toilet flange of the invention.

Another advantage of the toilet flange of this invention is: when performing a toilet installation, the toilet flange can be bolted to the bottom of the toilet before the toilet is placed in position over the toilet drain. The toilet and the toilet flange together can then be positioned over the drain pipe, and the toilet flange can simply be inserted into the drain pipe. Once in place on the floor, the toilet can then be rotationally adjusted to be in the correct rotational position with respect to the room, and the toilet flange seals will remain intact as the rotational adjustment is performed. This makes it possible to install the toilet with only one plumber, since there is no need for a second plumber to stand to the side of the toilet to look underneath the toilet to locate the two toilet flange bolts, make sure the flange bolts maintain an upright position and are at the correct angle, and then guide the toilet onto the flange bolts. The ability of only one plumber to do the toilet installation decreases the plumber's total labor costs.

In addition to use with the traditional toilet, the toilet flange of the invention may also be used for wall commodes and urinals.

A general aspect of the invention is a toilet flange apparatus for facilitating installation of a toilet onto a drain pipe, the toilet flange apparatus being rotationally adjustable while being irreversibly inserted into the drain pipe. The toilet flange apparatus includes: a flanged pipe having a pipe portion and a flange portion, the flange portion having a flange upper surface, the flange upper surface having at least one fastener projecting therefrom, with the pipe portion having a pipe outer surface and a pipe leading end. The pipe outer surface has a circumferential groove disposed between the flange portion and the pipe leading end, and the circumferential groove is configured to seat a sealing ring, with the pipe outer surface having a circumferential channel disposed between the flange portion and the pipe leading end. The toilet flange apparatus includes a circumferential gripping ring which includes: a channel guide ring configured to be seated rotatably within the circumferential channel, and a plurality of gripping projections extending from the channel guide ring towards the flange portion, and terminating with a trailing edge at an acute angle away from the pipe outer surface. The circumferential gripping ring cooperates with the circumferential channel so as to provide rotational adjustment of the flanged pipe as it is irreversibly inserted into the drain pipe.

In some embodiments, the toilet flange apparatus further includes: a sealing ring seated in the circumferential groove.

In some embodiments, the circumferential channel further includes an adjacent circumferential recess configured to accommodate the plurality of gripping projections when the toilet flange apparatus is inserted into the drain pipe.

In some embodiments, each gripping projection of the plurality of gripping projections is shaped like a tooth having a jagged trailing edge.

In some embodiments, each gripping projection of the plurality of gripping projections is made of springy material.

In some embodiments, the flange upper surface has a circumferential flange groove configured to seat a circumferential flange sealing ring.

In some embodiments, the circumferential gripping ring is made of at least one of: metal, plastic.

In some embodiments, the pipe leading end is tapered.

In some embodiments, the circumferential gripping ring has a break so as to enable the circumferential gripping ring to be expanded when applying and removing the circumferential gripping ring.

In some embodiments, the flanged pipe is made of at least one of: metal, plastic.

Another general aspect of the invention is a toilet flange apparatus for facilitating installation of a toilet onto an outer surface of a drain pipe, the toilet flange apparatus being rotationally adjustable while being irreversibly placed onto the drain pipe. This toilet flange apparatus includes: a flanged pipe having a pipe portion and a flange portion, the flange portion having a flange upper surface, the flange upper surface having at least one fastener projecting therefrom, with the pipe portion having a pipe inner surface and a pipe leading end. The pipe inner surface has a circumferential groove disposed between the flange portion and the pipe leading end, and the circumferential groove is configured to seat a sealing ring, with the pipe inner surface having a circumferential channel disposed between the flange portion and the pipe leading end. The toilet flange apparatus includes a circumferential gripping ring which includes: a channel guide ring configured to be seated rotatably within the circumferential channel, and a plurality of gripping projections extending from the channel guide ring towards the flange portion, and terminating with a trailing edge at an acute angle away from the pipe inner surface. The circumferential gripping ring cooperates with the circumferential channel so as to provide rotational adjustment of the flanged pipe as it is irreversibly inserted into the drain pipe.

In some embodiments, the toilet flange apparatus further includes: a sealing ring seated in the circumferential groove.

In some embodiments, the circumferential channel further includes an adjacent circumferential recess configured to accommodate the plurality of gripping projections when the toilet flange apparatus is inserted into the drain pipe.

In some embodiments, each gripping projection of the plurality of gripping projections is shaped like a tooth having a jagged trailing edge.

In some embodiments, each gripping projection of the plurality of gripping projections is made of springy material.

In some embodiments, the flange upper surface has a circumferential flange groove configured to seat a circumferential flange sealing ring.

In some embodiments, the circumferential gripping ring is made of at least one of: metal, plastic.

In some embodiments, the pipe leading end is tapered.

In some embodiments, the circumferential gripping ring has a break so as to enable the circumferential gripping ring to be contracted when applying and removing the circumferential gripping ring.

In some embodiments, the flanged pipe is made of at least one of: metal, plastic.

Another general aspect of the invention relates to a method of installing a toilet onto a drain pipe. The method comprises the steps of providing a toilet flange having a flange portion and a pipe portion and connecting a plurality of gripping projections to the pipe portion, wherein the gripping projections are rotatable about the pipe portion. The flange portion is connected to a lower portion of the toilet to form a substantially fluid-tight seal with the lower portion of a toilet. The pipe portion is connected to the drain pipe after connecting the flange portion to a lower portion of the toilet, to form a second substantially fluid-tight seal between the pipe portion and the drain pipe, wherein the plurality of gripping projections irreversibly engages the drain pipe, and wherein the pipe portion is rotatable about the drain pipe.

In some embodiments, at least one of the first and second substantially fluid-tight seals comprise an elastomeric sealing member.

In some embodiments, the pipe portion is rotatable by 360° about the drain pipe.

In some embodiments, the pipe portion and toilet are rotatable by 360° about the drain pipe.

BRIEF DESCRIPTION OF THE DRAWINGS

FIG. 3A is a perspective view of the outer circumferential gripping ring shown in FIG. 1.

FIG. 3B is an exploded perspective view of the outer circumferential gripping ring of FIG. 3A, showing the channel guide ring, and the gripping ring.

DETAILED DESCRIPTION

Figure 1:
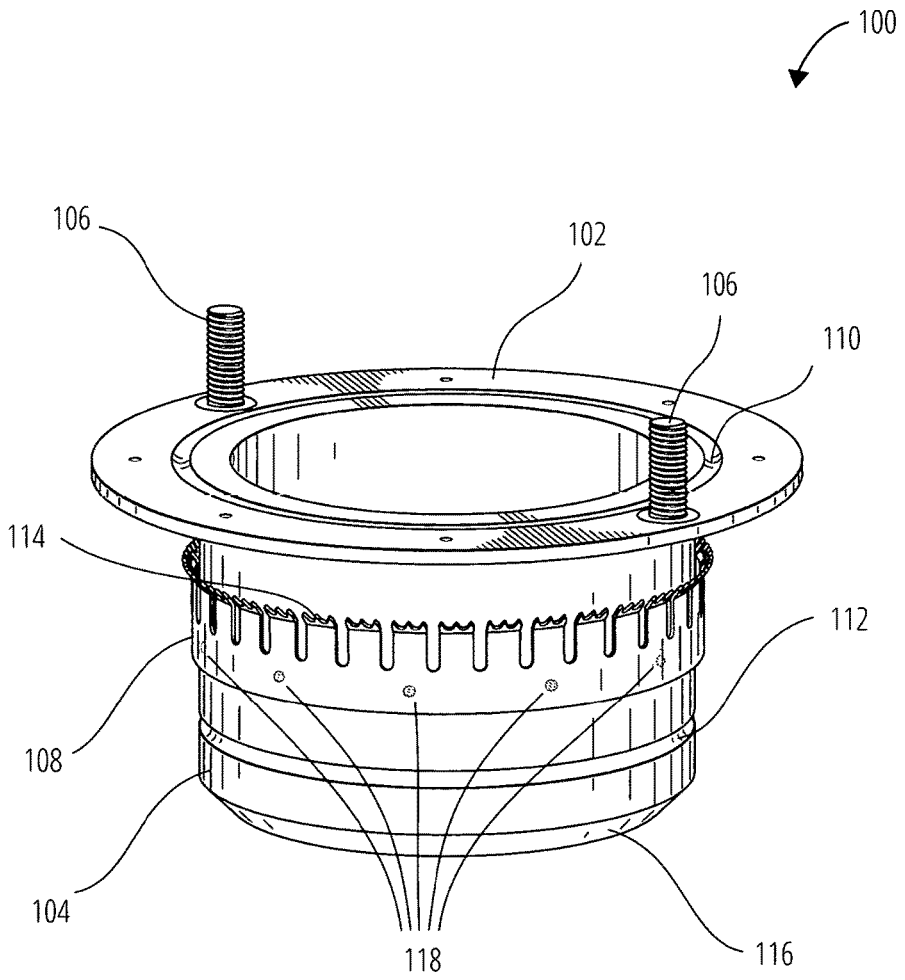
FIG. 1 is a perspective view of an embodiment of the toilet flange apparatus having an outer circumferential gripping ring.
Figure 9:
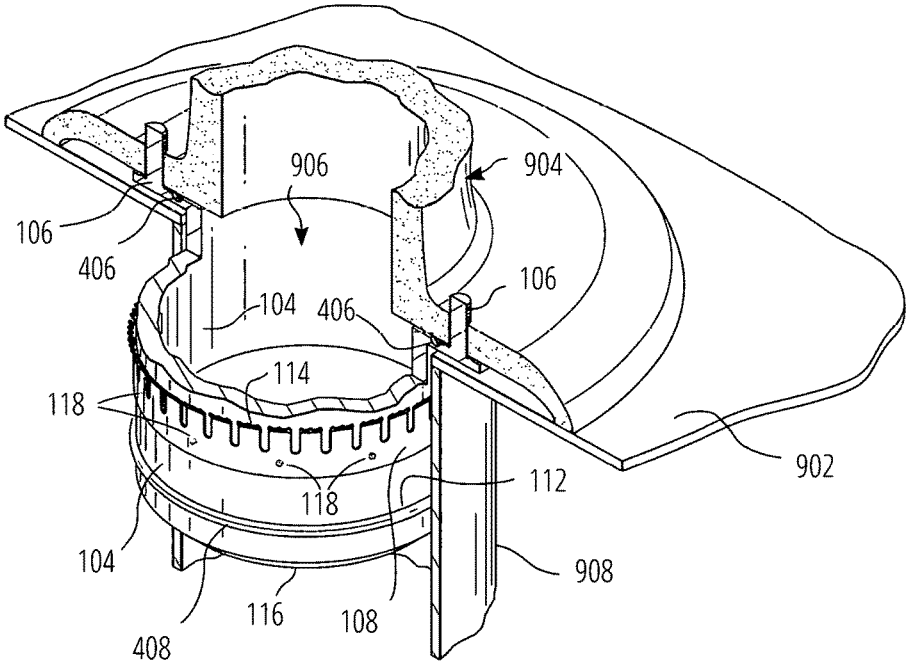
FIG. 9 is a perspective view of the self-sealing closet flange installed beneath a toilet and inside a drain pipe.

FIG. 1 shows an embodiment of a toilet flange apparatus 100 having a flange portion 102 which has a flange circumferential groove 110 which receives a first O-ring 406 (shown in FIG. 4), where the flange portion 102 and the flange circumferential groove 110 and the first O-ring 406 cooperate to form a seal with a lower portion of a toilet 904 (shown in FIG. 9). An at least one fastener 106 is used to tighten the flange portion 102 to the lower portion of the toilet 904. Fasteners 106 may include bolts, other threaded fasteners, clips, pins, and any other mechanical fastening mechanisms known in the art. In some embodiments, the fasteners 106 are formed as a portion of the flange portion 102. Although an O-ring 406 is specifically noted, one skilled in the art will appreciate that any elastomeric sealing member may be used, and that the circumferential groove 112 may have a size and dimension to accommodate such sealing members. The toilet flange apparatus 100 may be made from metal, plastic, polymer, ceramic, composites, or any other material known in the art.

The toilet flange apparatus 100 includes a pipe portion 104 and a circumferential gripping ring 108 having plurality of gripping projections 114 that grip the inside of a drain pipe 908 (shown in FIG. 9). The pipe portion 104 also includes a side circumferential groove 112 for receiving a second O-ring 408 (shown in FIG. 4) that forms an air-tight and liquid-tight seal against the inside of the drain pipe 908. The gripping ring 108 may be made from metal, plastic, or any other material that may be flexibly biased.

Also shown are weld spots 118 on the circumference of the circumferential gripping ring 108. Although weld spots 118 are illustrated, it will be clear to those skilled in the art that other thermal processes, adhesives, and mechanical fasteners, are contemplated for attaching the circumferential gripping ring 108 to the channel guide ring 302. In some embodiments, the circumferential gripping ring 108 and the channel guide ring 302 are formed from the same piece of material.

In this embodiment, the pipe leading end 116 has a beveled leading end, with an inside pipe portion wall extending downward lower than an outside pipe portion wall, to provide easy insertion of the toilet flange apparatus 100 into the drain pipe 908 (shown in FIG. 9).

Figure 2:
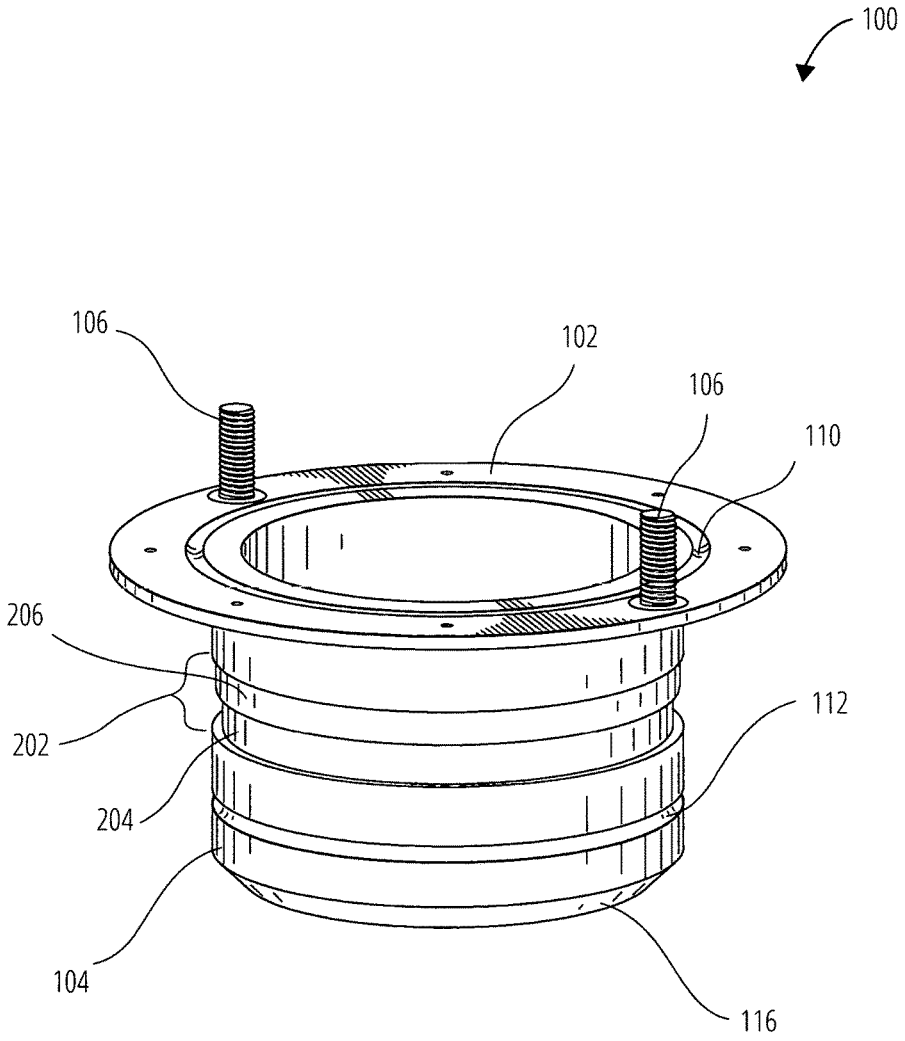
FIG. 2 is a perspective view of the embodiment FIG. 1 showing the circumferential channel on the outer surface of the pipe.

FIG. 2 shows an embodiment of a toilet flange apparatus 100 having a flange portion 102 which has a flange circumferential groove 110 which receives a first O-ring 406 (shown on FIG. 4), where the flange portion 102 and the flange circumferential groove 110 and the first O-ring 406 cooperate to form a seal with a lower portion of a toilet 904 (shown in FIG. 9). An at least one fastener 106 is used to tighten the flange portion 102 to the lower portion of the toilet 904.

The toilet flange apparatus 100 includes a pipe portion 104, and shown on the outside of the pipe portion 104 is the circumferential channel 202, having a circumferential channel deep portion 204, and an adjacent circumferential recess 206 to accommodate the circumferential gripping ring 108 (shown in FIG. 1 and FIG. 3). The circumferential channel 202 allows the circumferential gripping ring 108 to rotate with respect to the pipe portion 104. As a result, once the toilet flange apparatus 100 has been inserted into the drain pipe 908, the toilet flange apparatus 100 can be rotationally adjusted with respect to the drain pipe 908 (shown in FIG. 9) in the toilet flange apparatus 100 installation process. In particular, it will be appreciated that the toilet flange apparatus 100 can be rotationally adjusted with respect to the drain pipe 908 by 360° or more after the toilet flange apparatus 100 has been irreversibly connected to the drain pipe 908. Therefore, a toilet, once installed, will have 360° or more freedom of rotation, barring installation environment constraints, after being irreversibly connected to the drain pipe 908.

The pipe portion 104 also includes a side circumferential groove 112 for receiving a second O-ring 408 (shown in FIG. 4) that forms an air-tight and liquid-tight seal against the inside of the drain pipe 908. Although an O-ring 408 is specifically noted, one skilled in the art will appreciate that any elastomeric sealing member may be used, and that the circumferential groove 112 may have a size and dimension to accommodate such sealing members.

In this embodiment, the pipe leading end 116 has a beveled leading end, with an inside pipe portion wall extending downward lower than an outside pipe portion wall, to provide easy insertion of the toilet flange apparatus 100 into the drain pipe 908 (shown in FIG. 9).

FIGS. 3A and 3B show an embodiment of a circumferential gripping ring 108, having a channel guide ring 302 and a gripping ring 304, the gripping ring 304 having plurality of gripping projections 114 that grip the inside of a drain pipe 908 (shown in FIG. 9). Although not illustrated, the channel guide ring 302 may comprise an additional sealing member proximate the pipe portion 104 and/or the drain pipe 908 to facilitate additional fluid sealing.

To facilitate assembly of the circumferential gripping ring 108 on the circumferential channel 202, the gripping ring 304 has a gripping ring break 306, with gripping ring 304 having a cut through, so the gripping ring 304 can be expanded in diameter to be placed onto the pipe portion 104. In a similar manner, the channel guide ring 302 has a channel guide ring break 308, with the channel guide ring break 308 having a cut through, so the channel guide ring 302 can be expanded in diameter to be placed onto the pipe portion 104.

Also shown are weld spots 118 on the circumference of the circumferential gripping ring 108. Although weld spots 118 are illustrated, it will be clear to those skilled in the art that other thermal processes, adhesives, and mechanical fasteners, are contemplated for attaching the circumferential gripping ring 108 to the channel guide ring 302. In some embodiments, the circumferential gripping ring 108 and the channel guide ring 302 are formed from the same piece of material.

Figure 4:
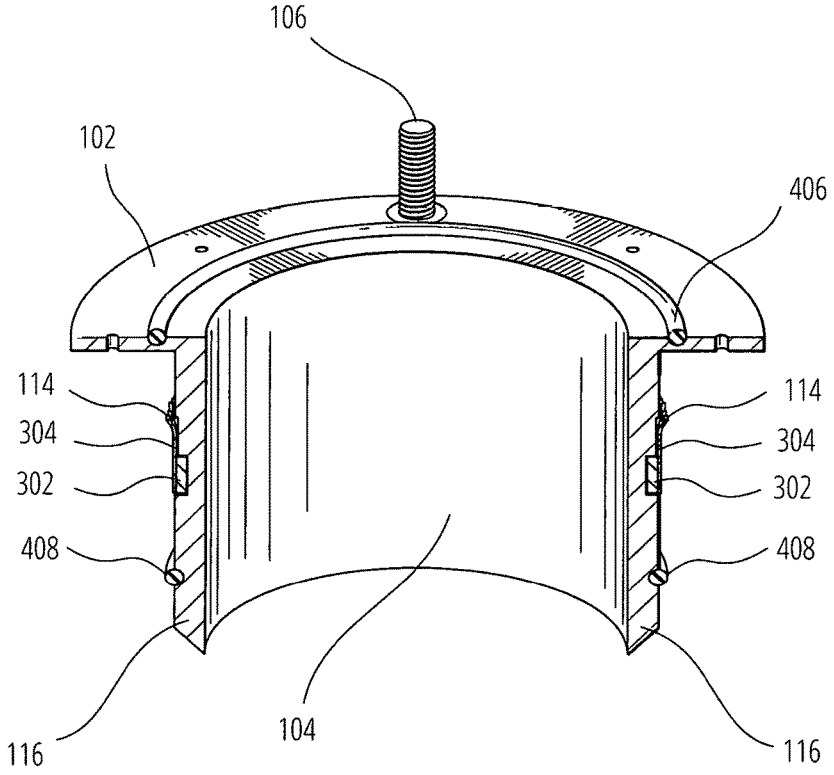
FIG. 4 is an interior cut-away perspective view of the toilet flange apparatus of FIG. 1.

FIG. 4 shows an embodiment of a toilet flange apparatus 100 having a flange portion 102 which has a flange circumferential groove 110 (shown in FIG. 1) which receives a first O-ring 406, where the flange portion 102 and the flange circumferential groove 110 and the first O-ring 406 cooperate to form a seal with a lower portion of a toilet 904 (shown in FIG. 9). An at least one fastener 106 is used to tighten the flange portion 102 to the lower portion of the toilet 904. Traditionally, there are two fasteners per toilet.

The toilet flange apparatus 100 includes a pipe portion 104 upon which is mounted a channel guide ring 302 and a gripping ring 304, the gripping ring 304 having plurality of gripping projections 114 that grip the inside of a drain pipe 908 (shown in FIG. 9). The pipe portion 104 also includes a side circumferential groove 112 (shown in FIG. 1) for receiving a second O-ring 408 that forms an air-tight and liquid-tight seal against the inside of the drain pipe 908.

In this embodiment, the pipe leading end 116 has a beveled leading end, with an inside tube wall extending downward lower than an outside tube wall, to provide easy insertion of the toilet flange apparatus 100 into the drain pipe 908 (shown in FIG. 9).

Figure 5:
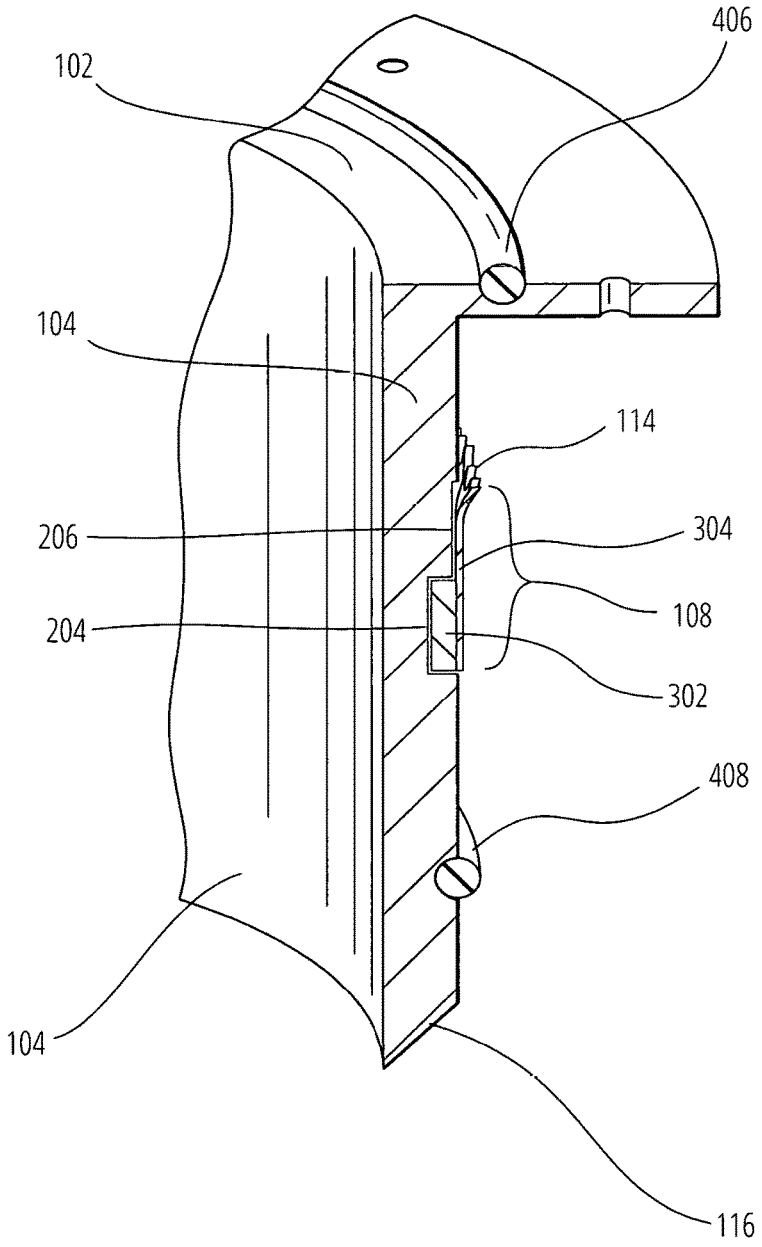
FIG. 5 is an interior cut-away close-up view of the toilet flange apparatus showing details of the circumferential gripping ring, the channel guide ring, and the gripping ring.

FIG. 5 shows a close-up view of an embodiment of a toilet flange apparatus 100 having a flange portion 102 which has a flange circumferential groove 110 (shown in FIG. 1) which receives a first O-ring 406, where the flange portion 102 and the flange circumferential groove 110 and the first O-ring 406 cooperate to form a seal with a lower portion of a toilet 904 (shown in FIG. 9).

The toilet flange apparatus 100 includes a pipe portion 104 with a circumferential channel deep portion 204 and an adjacent circumferential recess 206 upon which is mounted a channel guide ring 302 and a gripping ring 304, the gripping ring 304 having plurality of gripping projections 114 that grip the inside of a drain pipe 908 (shown in FIG. 9). The pipe portion 104 also includes a side circumferential groove 112 (shown in FIG. 1) for receiving a second O-ring 408 that forms an air-tight and liquid-tight seal against the inside of the drain pipe 908 (shown in FIG. 9).

In this embodiment, the pipe leading end 116 has a beveled leading end, with an inside pipe portion wall extending downward lower than an outside pipe portion wall, to provide easy insertion of the toilet flange apparatus 100 into the drain pipe 908 (shown in FIG. 9).

Figure 6:
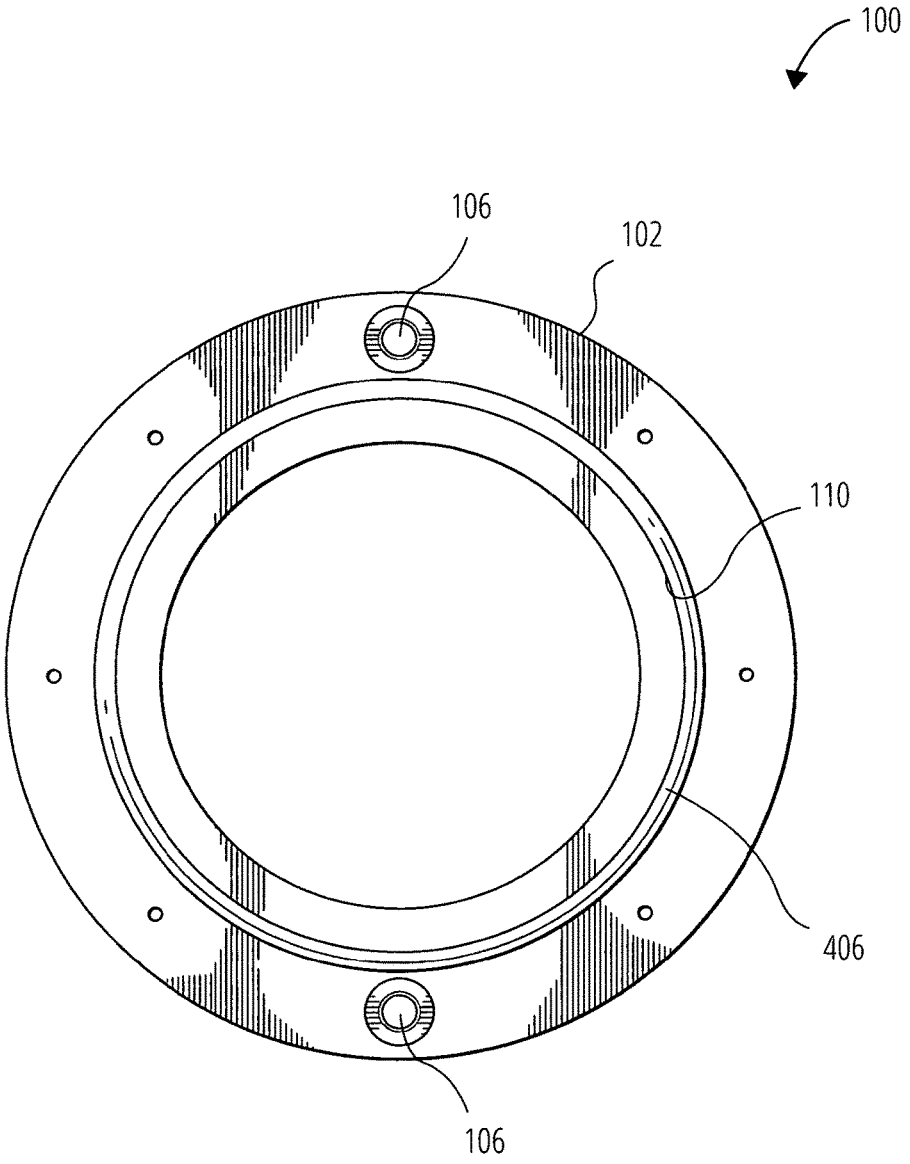
FIG. 6 is a top view of the anterior end of the toilet flange apparatus.

FIG. 6 shows a top view of the toilet flange apparatus 100, having a flange portion 102 which has a flange circumferential groove 110 (shown in FIG. 1) which receives a first O-ring 406, where the flange portion 102 and the flange circumferential groove 110 and the first O-ring 406 cooperate to form a seal with a lower portion of a toilet 904 (shown in FIG. 9). An at least one fastener 106 is used to tighten the flange portion 102 to the lower portion of the toilet 904.

Figure 7:
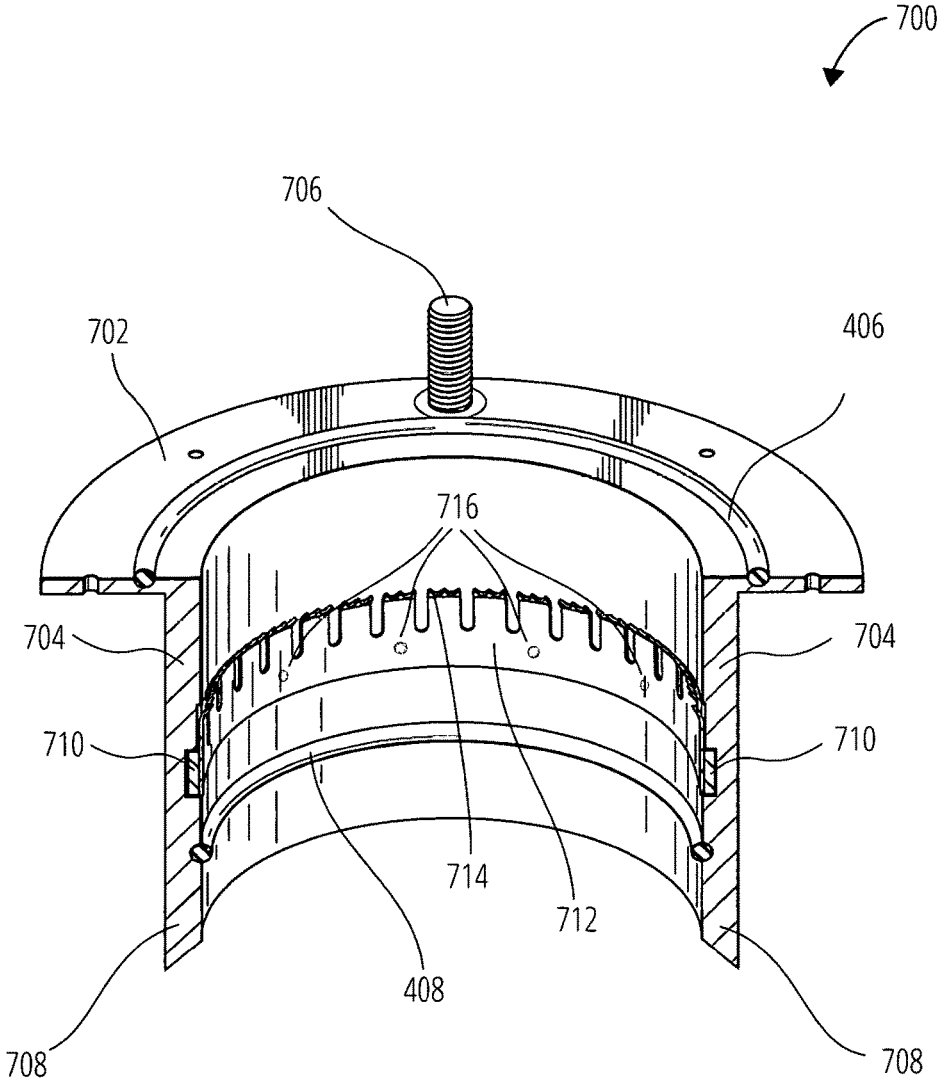
FIG. 7 is an interior, cut away view of the toilet flange apparatus, showing an alternative embodiment for placement on the outside of a drain pipe.

FIG. 7 shows an alternate embodiment of a toilet flange apparatus 700 for placement on the outside of a drain pipe, having a flange portion 702 which has a flange circumferential groove 110 (shown in FIG. 1) which receives a first O-ring 406, where the flange portion 702 and the flange circumferential groove 110 and the first O-ring 406 cooperate to form a seal with a lower portion of a toilet 904 (shown in FIG. 9). An at least one fastener 706 is used to tighten the flange portion 702 to the lower portion of the toilet 904.

The toilet flange apparatus 700 includes a pipe portion 704 upon which is mounted a channel guide ring 710 and a teeth ring 712, the teeth ring 712 having plurality of gripping projections 714 that grip the outside of a drain pipe. The pipe portion 704 also includes a side circumferential groove 112 (shown in FIG. 1) for receiving a second O-ring 408 that forms an air-tight and liquid-tight seal against the outside of the drain pipe 908.

Also shown are weld spots 716 on the circumference of the teeth ring 712.

In this embodiment, the leading end of the tub 708 has a beveled leading end, with an outside pipe portion wall extending downward more than an inside pipe portion wall to provide easy insertion of the toilet flange apparatus 700 into the drain pipe.

Figure 8:
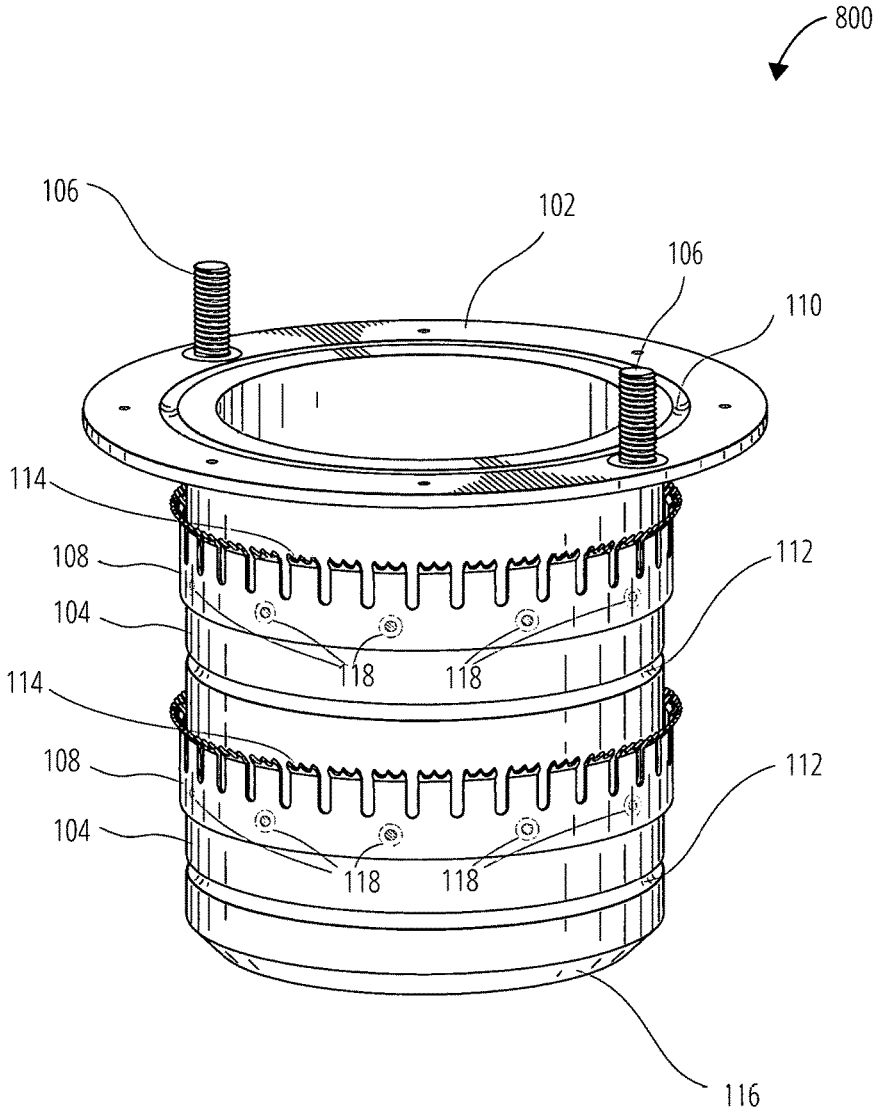
FIG. 8 is a perspective view of the toilet flange apparatus with two circumferential gripping rings and two side circumferential grooves.

FIG. 8 shows an embodiment of a toilet flange apparatus 800 having two circumferential gripping rings 108 and two side circumferential grooves 112, also having a flange portion 102 which has a flange circumferential groove 110 which receives a first O-ring 406 (shown in FIG. 4), where the flange portion 102, the flange circumferential groove 110, and the first O-ring 406 cooperate to form a seal with a lower portion of a toilet 904 (shown in FIG. 9). An at least one fastener 106 is used to tighten the flange portion 102 to the lower portion of the toilet 904.

The toilet flange apparatus 100 includes a pipe portion 104 and the two circumferential gripping rings 108, each having a plurality of gripping projections 114 that grip the inside of a drain pipe 908 (shown in FIG. 9). The pipe portion 104 also includes the two side circumferential grooves 112, each for receiving a second O-ring 408 (shown in FIG. 4) that form an air-tight and liquid-tight seal against the inside of the drain pipe 908.

Also shown are weld spots 118 on the circumference of each of the two circumferential gripping rings 108. Although weld spots 118 are illustrated, it will be clear to those skilled in the art that other thermal processes, adhesives, and mechanical fasteners, are contemplated for attaching the circumferential gripping ring 108 to the channel guide ring 302. In some embodiments, the circumferential gripping ring 108 and the channel guide ring 302 are formed from the same piece of material.

In this embodiment, the pipe leading end 116 has a beveled leading end, with an inside pipe portion wall extending downward lower than an outside pipe portion wall, to provide easy insertion of the toilet flange apparatus 800 into the drain pipe 908 (shown in FIG. 9).

FIG. 9 shows an embodiment of a toilet flange apparatus 100 installed beneath a toilet 904 having a toilet exit pipe 906 which drains into the toilet flange apparatus 100. Also shown is the floor surface 902.

The toilet flange apparatus 100 has an at least one fastener 106 which inserts into bolt holes in a base of the toilet 904. The toilet flange apparatus 100 has a flange portion 102 (shown in FIG. 1) which has a flange circumferential groove 110 which receives a first O-ring 406 (shown in FIG. 4), where the flange portion 102 and the flange circumferential groove 110 and the first O-ring 406 cooperate to form a seal with a lower portion of a toilet 904. The at least one fastener 106, along with a nut (not shown), is used to tighten the flange portion 102 (shown in FIG. 1) to the lower portion of the toilet 904.

The toilet flange apparatus 100 includes a pipe portion 104 and a circumferential gripping ring 108 having plurality of gripping projections 114 that grip the inside of a drain pipe 908. The pipe portion 104 also includes a side circumferential groove 112 (shown in FIG. 1) for receiving a second O-ring 408 that forms an air-tight and liquid-tight seal against the inside of the drain pipe 908.

Also shown are weld spots 118 on the circumference of the circumferential gripping ring 108. Although weld spots 118 are illustrated, it will be clear to those skilled in the art that other thermal processes, adhesives, and mechanical fasteners, are contemplated for attaching the circumferential gripping ring 108 to the channel guide ring 302. In some embodiments, the circumferential gripping ring 108 and the channel guide ring 302 are formed from the same piece of material.

In this embodiment, the pipe leading end 116 has a beveled leading end, with an inside tube wall extending downward lower than an outside tube wall, to provide easy insertion of the toilet flange apparatus 100 into the drain pipe 908.

In an embodiment, the toilet flange apparatus 100 is formed as an integral component of a toilet, without the need for fasteners 106 or sealing means 406 between the toilet flange apparatus 100 and the toilet. Installation of the toilet therefore merely comprises mating the toilet to a drain pipe 908.

Other modifications and implementations will occur to those skilled in the art without departing from the spirit and the scope of the invention as claimed. It will therefore be understood by those skilled in the art that various alterations, modifications in form and in detail, and combinations of embodiments may be made. Accordingly, the above description is not intended to limit the invention, except as indicated in the following claims.

What is claimed is:

1. A toilet flange apparatus for facilitating installation of a toilet onto a drain pipe, the toilet flange apparatus being rotationally adjustable while being irreversibly inserted into the drain pipe, the apparatus comprising:

a flanged pipe having a pipe portion and a flange portion,
- the flange portion having a flange upper surface,
- the flange upper surface having at least one fastener projecting therefrom,
- the pipe portion having a pipe outer surface, and a pipe leading end,
- the pipe outer surface having a circumferential groove disposed between the flange portion and the pipe leading end, the circumferential groove being configured to seat a sealing ring,
- the pipe outer surface having a circumferential channel disposed between the flange portion and the pipe leading end; and a circumferential gripping ring including:
- a channel guide ring configured to be seated rotatably within the circumferential channel; and
- a plurality of gripping projections extending from the channel guide ring towards the flange portion, and terminating with a trailing edge at an acute angle away from the pipe outer surface,
- the circumferential gripping ring cooperating with the circumferential channel so as to provide rotational adjustment of the flanged pipe as it is irreversibly inserted into the drain pipe.

2. The toilet flange apparatus of claim 1, further including: a sealing ring seated in the circumferential groove.

3. The toilet flange apparatus of claim 1, wherein the circumferential channel includes an adjacent circumferential recess configured to accommodate the plurality of gripping projections when the toilet flange apparatus is inserted into the drain pipe.

4. The toilet flange apparatus of claim 1, wherein each gripping projection of the plurality of gripping projections is shaped like a tooth having a jagged trailing edge.

5. The toilet flange apparatus of claim 1, wherein the plurality of gripping projections are configured to flexibly engage a proximate surface of the drain pipe.

6. The toilet flange apparatus of claim 1, wherein the flange upper surface has a circumferential flange groove configured to seat a circumferential flange sealing ring.

7. The toilet flange apparatus of claim 1, wherein the pipe leading end is tapered.

8. The toilet flange apparatus of claim 1, wherein the circumferential gripping ring has a break so as to enable the circumferential gripping ring to be expanded when applying and removing the circumferential gripping ring.

9. A toilet flange apparatus for facilitating installation of a toilet onto an outer surface of a drain pipe, the toilet flange apparatus being rotationally adjustable while being irreversibly placed onto the drain pipe, the apparatus comprising:

a flanged pipe having a pipe portion and a flange portion,
- the flange portion having a flange upper surface,
- the flange upper surface having at least one fastener projecting therefrom,
- the pipe portion having a pipe inner surface, and a pipe leading end,
- the pipe inner surface having a circumferential groove disposed between the flange portion and the pipe leading end, the circumferential groove being configured to seat a sealing ring,
- the pipe inner surface having a circumferential channel disposed between the flange portion and the pipe leading end; and a circumferential gripping ring including:
- a channel guide ring configured to be seated rotatably within the circumferential channel; and
- a plurality of gripping projections extending from the channel guide ring towards the flange portion, and terminating with a trailing edge at an acute angle away from the pipe inner surface, the circumferential gripping ring cooperating with the circumferential channel so as to provide rotational adjustment of the flanged pipe as it is irreversibly inserted onto the drain pipe.

10. The toilet flange apparatus of claim 9, further including:

a sealing ring seated in the circumferential groove.

11. The toilet flange apparatus of claim 9, wherein the circumferential channel includes an adjacent circumferential recess configured to accommodate the plurality of gripping projections when the toilet flange apparatus is inserted onto the drain pipe.

12. The toilet flange apparatus of claim 9, wherein each gripping projection of the plurality of gripping projections is shaped like a tooth having a jagged trailing edge.

13. The toilet flange apparatus of claim 9, wherein the plurality of gripping projections are configured to flexibly engage a proximate surface of the drain pipe.

14. The toilet flange apparatus of claim 9, wherein the flange upper surface has a circumferential flange groove configured to seat a circumferential flange sealing ring.

15. The toilet flange apparatus of claim 9, wherein the pipe leading end is tapered.

16. The toilet flange apparatus of claim 9, wherein the circumferential gripping ring has a break so as to enable the circumferential gripping ring to be contracted when applying and removing the circumferential gripping ring.

17. A method of installing a toilet onto a drain pipe, comprising the steps of:

providing a toilet flange having a flange portion and a pipe portion;

connecting a plurality of gripping projections to the pipe portion, wherein the gripping projections are rotatable about the pipe portion;

connecting the flange portion to a lower portion of the toilet to form a substantially fluid-tight seal with the lower portion of a toilet;

connecting the pipe portion to the drain pipe after connecting the flange portion to a lower portion of the toilet, to form a second substantially fluid-tight seal between the pipe portion and the drain pipe, wherein the plurality of gripping projections irreversibly engages the drain pipe, and wherein the pipe portion is rotatable about the drain pipe.

18. The method of installing a toilet onto a drain pipe of claim 17, wherein at least one of the first and second substantially fluid-tight seals comprises an elastomeric sealing member.

19. The method of installing a toilet onto a drain pipe of claim 17, wherein the pipe portion is rotatable by 360° about the drain pipe.

20. The method of installing a toilet onto a drain pipe of claim 17, wherein the pipe portion and toilet are rotatable by 360° about the drain pipe.

* * * * *